US006354031B1

(12) United States Patent
Meur

(10) Patent No.: US 6,354,031 B1
(45) Date of Patent: Mar. 12, 2002

(54) DEVICE FOR THE PRESENTATION OF DOCUMENTS

(75) Inventor: Olivier Meur, Aywaille (BE)

(73) Assignee: Art-Service, S.A., Herstal (BE)

( * ) Notice: Subject to any disclaimer, the term of this patent is extended or adjusted under 35 U.S.C. 154(b) by 0 days.

(21) Appl. No.: 09/180,907

(22) PCT Filed: May 20, 1997

(86) PCT No.: PCT/BE97/00061

§ 371 Date: May 3, 1999

§ 102(e) Date: May 3, 1999

(87) PCT Pub. No.: WO97/44770

PCT Pub. Date: Nov. 27, 1997

(30) Foreign Application Priority Data

May 21, 1996 (BE) ..... 9600452

(51) Int. Cl.[7] ..... A47G 1/06

(52) U.S. Cl. ..... 40/781; 40/732; 40/757; 40/768; 40/780

(58) Field of Search ..... 40/732, 757, 768, 40/780, 781

(56) References Cited

U.S. PATENT DOCUMENTS

| | | | | | |
|---|---|---|---|---|---|
| 398,953 | A | * | 3/1889 | East | 40/727 |
| 463,500 | A | * | 11/1891 | Follenius | 40/124.5 |
| 1,692,999 | A | * | 11/1928 | Siegel | 40/732 |
| 1,842,285 | A | * | 1/1932 | Place | 40/781 |
| 3,408,759 | A | * | 11/1968 | Rotheraine et al. | 40/732 |
| 3,918,187 | A | * | 11/1975 | Vogele | 40/781 |
| 4,283,870 | A | * | 8/1981 | Stetler | 40/791 |
| 4,794,714 | A | * | 1/1989 | Weisgerber | 40/768 |
| 4,805,326 | A | * | 2/1989 | Rainone et al. | 40/780 |
| 4,949,483 | A | * | 8/1990 | Dobson et al. | 40/740 |
| 5,012,601 | A | * | 5/1991 | Garland et al. | 40/781 |
| 5,081,777 | A | * | 1/1992 | Kim | 40/781 |
| 5,230,172 | A | * | 7/1993 | Hsu | 40/732 |
| 5,524,370 | A | * | 6/1996 | Roy | 40/748 |
| 5,749,184 | A | * | 5/1998 | McKann | 52/204.1 |
| 5,974,714 | A | * | 11/1999 | Jones | 40/768 |

* cited by examiner

*Primary Examiner*—B. Dayoan
*Assistant Examiner*—Andrea Chop
(74) *Attorney, Agent, or Firm*—Olson & Hierl, Ltd.

(57) ABSTRACT

A device for the presentation of documents, which includes a back element (3; 13; 17) and a frame (2) capable of surrounding the back element (3; 13; 17). The latter includes one or more fixing elements (9; 10), each comprising a part (20) capable of deforming elastically. When the device (1) is in the closed state, each of the elements applies a clamping force to the frame (2), causing the document (8) to be clamped.

19 Claims, 5 Drawing Sheets

DEVICE FOR THE PRESENTATION OF DOCUMENTS

TECHNICAL FIELD

The present invention relates to a device for the presentation of pictures, posters or any other type of document.

STATE OF THE PRIOR ART

The presentation of pictures, posters, photos or documents of any type in a frame is realized in many ways, depending on aesthetic criteria but also on the ease of installation and on the cost price. Frames according to the prior art often consist of a section made up into a rectangular frame, of a sheet of glass or of transparent synthetic material, of a support panel and of various accessories which provide mounting and fixing. In general, these systems provide effective mounting but do not enable the frame to be easily and quickly dismantled, for example in order to replace the document to be displayed.

Such easy replacement of the document is a desirable advantage in applications such as the posting, in public places, of semi-permanent information, for example timetables, tariffs, programs and menus.

The frames according to the prior art are usually intended to be applied against an opaque support, such as a wall. In some applications, it is desirable to be able to display documents on both sides of the frame. Such a frame may then be applied against a pane, or held in space, in such a way that both its faces can be seen.

U.S. Pat. No. 4,385,744 teaches a frame, which allows theft-proof mounting against a wall. The mounting against a wall is provided by two fixed supports which engage in a groove made on the rear face of the upper part of the frame and by a catch mechanism which engages in a groove made in the rear face of the lower part of the frame. This support mechanism is invisible and inaccessible. Dismantling requires a special tool. This patent discloses a mechanism for mounting against a wall but does not describe a mechanism for easily replacing the document.

In addition, U.S. Pat. No. 3,918,187 teaches an assembly for an indicator panel, which enables the displayed document to be easily changed. This assembly comprises a back element and a frame, at least one of whose uprights is made of a flexible material. By deforming the flexible upright, the frame is applied against the back element. By releasing this upright of the frame, it engages in the rear of the back element and thus closes the assembly.

Because of the presence of a flexible upright, likely to deform due to the effect of the weight, this frame is not well suited to displaying large documents.

OBJECTS OF THE INVENTION

One object of the present invention is to provide a frame, which enables the displayed document to be easily and quickly replaced.

Another object of the present invention is to provide a frame, which can display a document, both on its front face and on its rear face, when it is applied against a transparent support such as a pane or is held in space.

SUBJECT OF THE INVENTION

The subject of the present invention is a device for the presentation of flat documents, enabling the document to be replaced by opening and closing the device, which includes a back element, a document, optionally protected by a transparent sheet, and a frame capable of surrounding the back element. The frame includes a rim suitable for bearing against the periphery of the document or of the transparent sheet. The back element includes one or more fixing elements capable of fastening the frame to the back element, each comprising a part capable of deforming elastically. Each part capable of deforming elastically applies, when the device is in the closed state, a clamping force against the frame, causing, in reaction, the document, optionally protected by a transparent sheet, to be clamped between the rim and the back element. In a preferred variant of the device according to the invention, the frame, on at least two of its inner faces, includes a groove into which the fixing elements can engage. In a preferred manner, these fixing elements are all ball catches. The frame may consist of an assembly of aluminum sections.

The back element may comprise an inner frame consisting of an assembly of sections, for example made of aluminum, and a back sheet. The back sheet may be transparent, for example made of polyvinylchloride (PVC), or made of an opaque material such as agglomerated wood.

In one variant of the device according to the invention, the back element is a solid panel, which may consist of agglomerated wood particles, such as medium-density fiberboard (MDF).

In another variant of the device according to the invention, the back element includes a back sheet and at least one added piece. The said at least one added piece is made of a material chosen from the group consisting of wood, agglomerated wood and polyvinylchloride (PVC).

The frame may be joined to the back element by a hinge.

In its upper part, the back element may include a means for holding the document in place.

The back element may be permanently fixed to a support, such as wall or another vertical partition, for example by means of two screws. This ensures that the back element is firmly fixed to the support and is safe from theft.

The frame and the transparent sheet can be easily dismantled, simply by pulling the frame forwards. Dismantling may be performed either manually or using a lever.

It is not necessary to detach the back element from its support in order to replace the document.

No fixing or closure accessory is visible, which gives the whole assembly an aesthetic appearance while reducing the risk of the frame being dismantled by malefactors.

The subject of the invention is also a device for the presentation of flat documents, allowing presentation of documents on both faces, the device being formed by joining two simple devices back to back.

DETAILED DESCRIPTION OF THE INVENTION

Other features and advantages of the devices according to the invention will emerge from the description below of particular embodiments, reference being made to the appended drawings in which.

Figure 1:
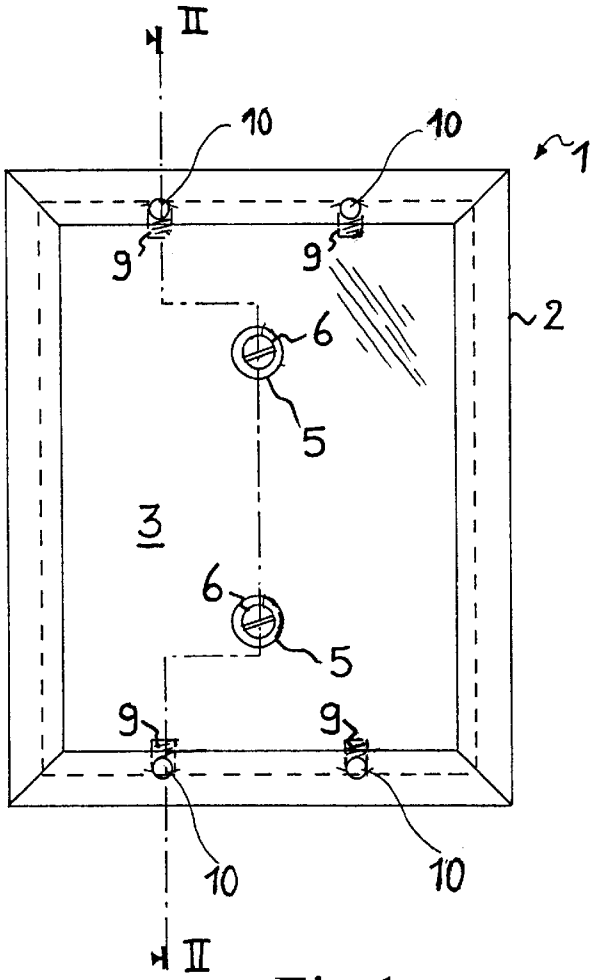
FIG. 1 is a front view of a first embodiment of a device according to the invention.

FIG. 1 shows an entire device 1, seen from the front, comprising four mitered sections, forming a frame 2, and a back panel 3. As may be more clearly seen in FIG. 2, the back panel 3 may be fixed to a wall 4 by means of the chamfered holes 5, which may receive the screws 6.

The device 1 furthermore includes a transparent sheet 7, made of glass or of synthetic material, and a document 8, for example a photo. In the case in which the document to be displayed is sufficiently rigid, and has a sufficiently resistant surface, the transparent sheet 7 may be omitted.

Catches 9, each including a ball 10, are embedded in the edges (or sides) of the back panel 3. The embodiment illustrated shows an arrangement in which four catches 3 are placed in two opposite edges of the panel 3.

The frame 2 is provided with a longitudinal groove 11 capable of receiving the balls 10 of the catches 9. The frame 2 may be applied and fixed to the back panel 3 by a simple snap-fastening mechanism.

Figure 3:
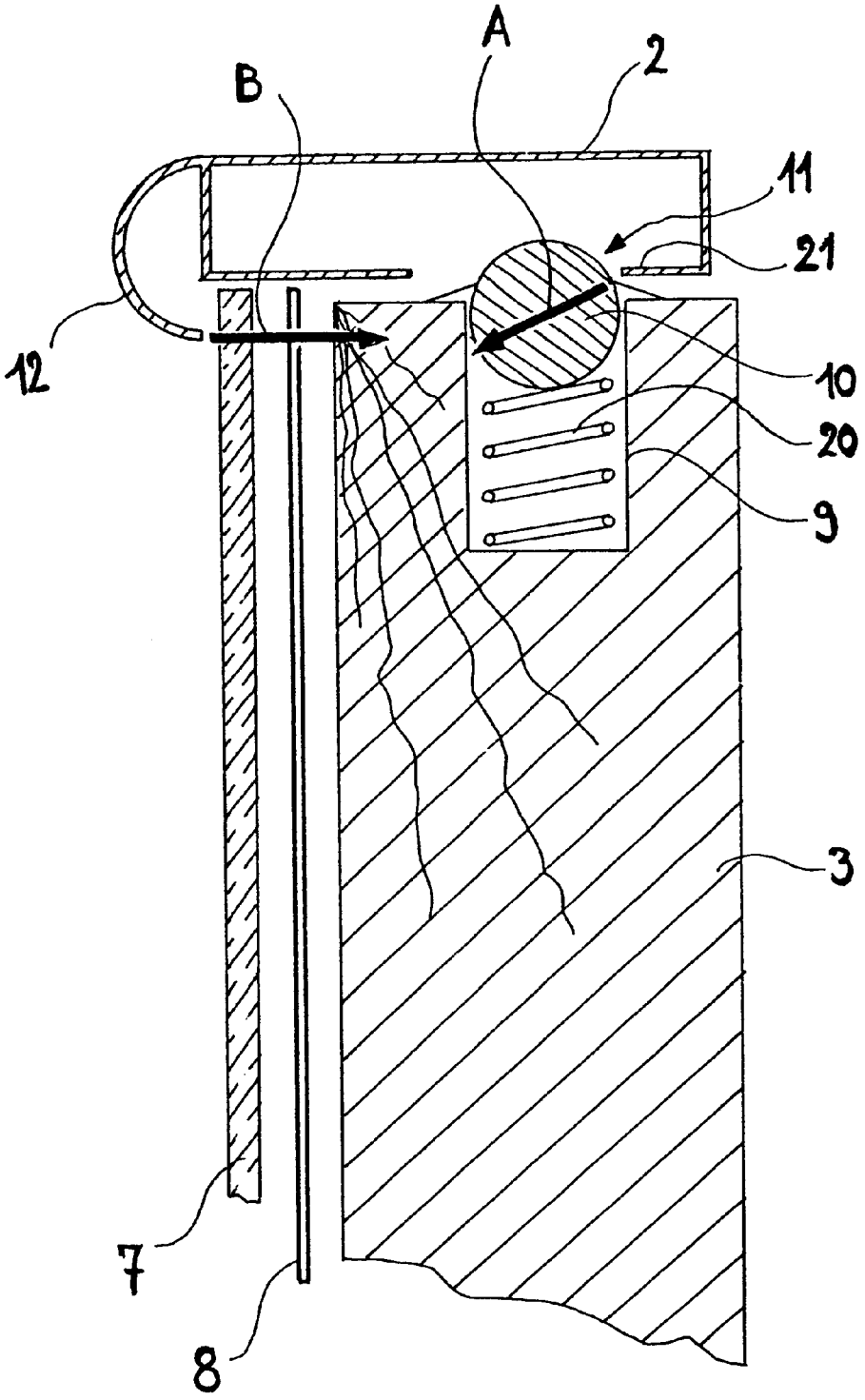
FIG. 3 is a cross-sectional view of a detail of the first embodiment of a device according to the invention.

FIG. 3 is a detailed view in which it may more clearly be seen that the sections of the frame 2 include a rim 12 which extends towards the front of the device 1 and is bent over towards the center of the frame 2. This rim 12 thus retains the sheet of glass or of transparent material 7 and the document 8. FIG. 3 also shows a catch 9 with its ball 10 engaged in the groove 11 of a section of the frame 2. The thickness of the back element 3 and the position of the groove 11 of the frame 2 are such that the back element 3 is slightly proud at the rear of the frame 2 when the device 1 is assembled, thus leaving a space between the wall 4 and the frame 2. This arrangement makes it easier to dismantle the device.

The sections of the frame 2 are assembled permanently, for example by crimping steel corner braces in the groove 11. These sections may be produced by extruding aluminum, or may be made of a synthetic material or any other suitable material.

The transparent sheet 7 is either a sheet of polystyrene or of polycarbonate, having a thickness which may vary from 0.5 to 2 mm, or a sheet of glass having a thickness which may vary from 1.5 to 2.5 mm.

Figure 2:
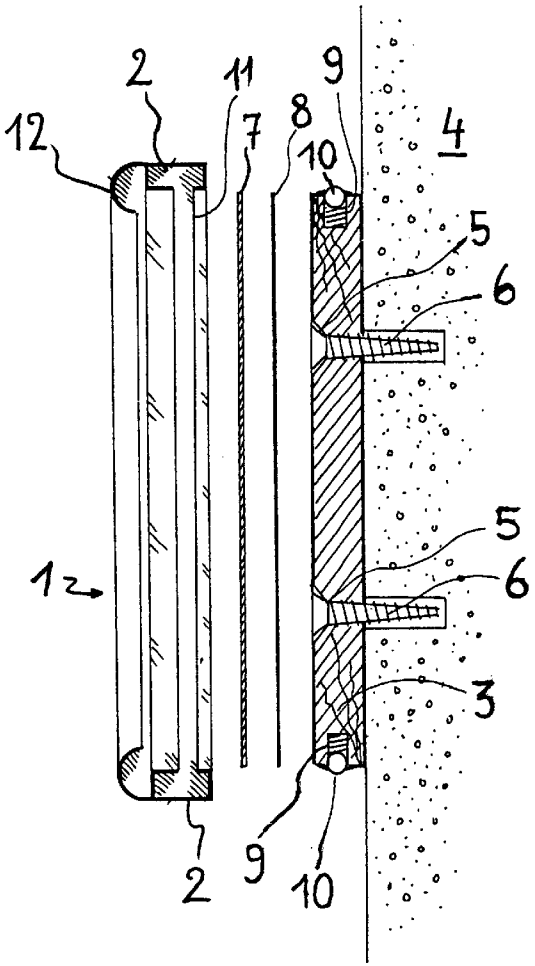
FIG. 2 is an exploded view of a cross-section on the line II—II in FIG. 1.

The back element 3, which is solid in the embodiment shown in FIGS. 1 to 3, may be made of any material in which side perforations intended to contain the body of the catches can be easily made. Such a material is, for example, medium-density fiberboard (MDF).

The back panel 3 has a thickness, which may vary from 10 to 20 mm. The thickness must be sufficient to be able to fix the catches 9 in its edges.

The ball 10 catches 9, are known in the furniture industry and are available in various models and sizes. The type of catch used in the first embodiment of the device 1 according to the present invention is of the embedding type.

Figure 4:
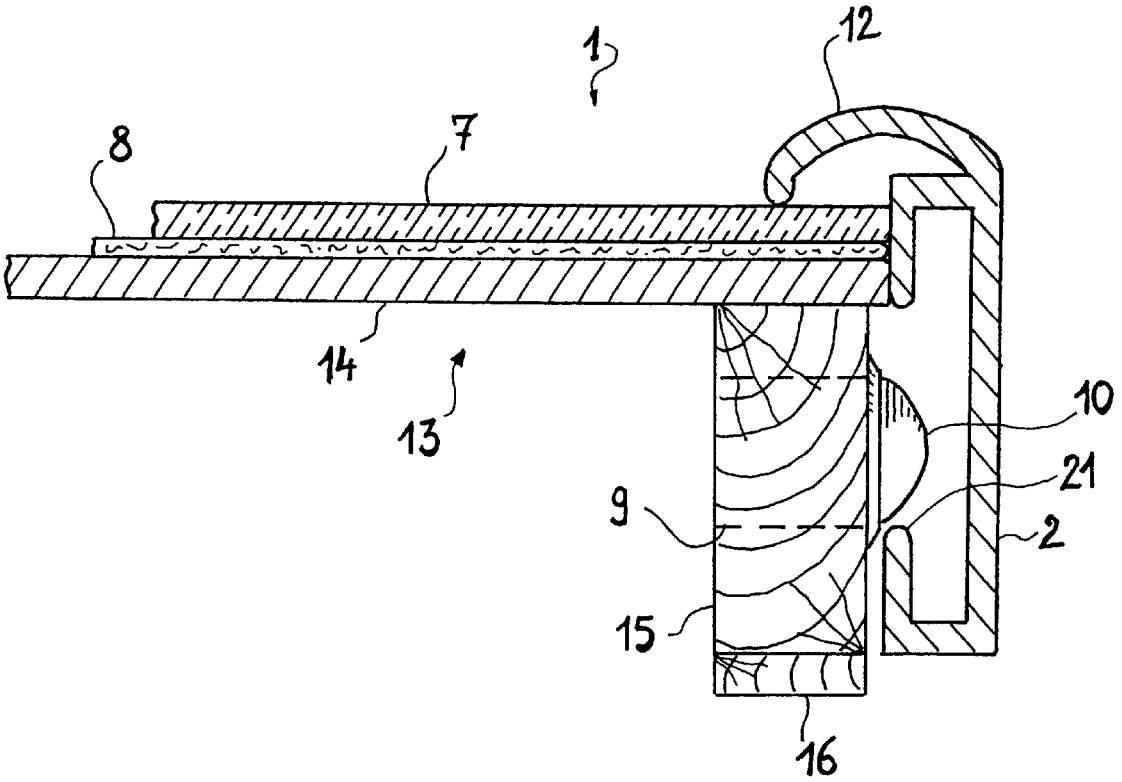
FIG. 4 is a cross-sectional view of a detail of a second embodiment of a device according to the invention.

In a second embodiment, shown in FIG. 4, the back element 13 includes a back sheet 14 and added pieces 15 (only one of which is shown in the Figure). The added pieces 15 may be fixed to a support (for example a wall or a window) by any suitable means. It is possible, for example, to use a double-sided adhesive 16.

The catches 9 are conveniently placed in the added pieces 15, which may be of the same kind as the back panel 3. In this case, screw-type catches are preferably used.

Figure 5:
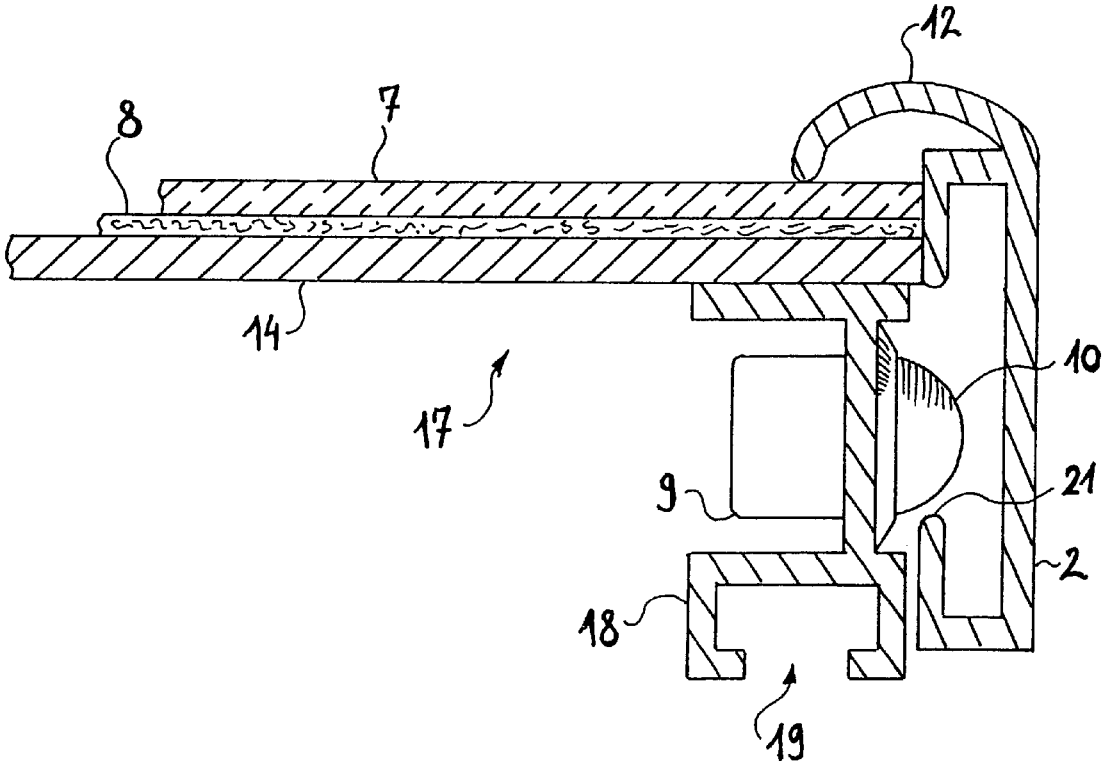
FIG. 5 is a cross-sectional view of a detail of a third embodiment of a device according to the invention.

In a third embodiment, shown in FIG. 5, the back element 17 comprises an assembly of sections 18 substantially in the form of a "U", which form an inner frame having dimensions slightly less than those of the frame 2, and a back sheet 14.

The ball 10 catches 9 are crimped or screwed into the central part of the "U" of the section 18.

The section 18 comprises a groove 19. The corners of the inner frame may be joined together, for example by crimping or screwing steel corner braces into the groove 19. This groove 19 may also be used for inserting one or more suspension fittings allowing to suspend the frame from a nail or using a cable.

These last two embodiments have the advantage of providing a particularly lightweight device.

It is important to note that, both for the second and for the third embodiment, the back sheet 14 may be an opaque sheet, of the same kind as the back panel 3 in the first embodiment shown, either made of medium-density fiberboard (MDF) or of polyvinylchloride (PVC). It may also consist of a transparent sheet, of the same kind as the transparent sheet 7.

In the latter case, if the device 1 according to the invention is applied against a window, or simply hung in a space so that both its faces are visible, and if the document 8 is printed on both sides, it may be seen from each side of the device 1.

In the examples illustrated, the catches 9 are engaged in the groove 11 of the frame 2 when the latter is applied against the back element (3; 13; 17). The ball of the ball catch 9 is applied by the spring 20 against the rear lip 21 of the groove 11. This applies a force in the direction of the arrow A indicated in FIG. 3. A reaction force, indicated by the arrow B, is applied by the rim 12 against the transparent sheet 7 and/or the document 8, thus clamping it. The clamping force may be adapted, depending on the applications, by modifying the size of the frame 2, the type and number of the catches 9 used and the shape of the groove 11. The mechanism of the ball 10 of the catch 9 makes it possible to maintain clamping of the document 8 despite slight variations in the thickness of the document 8 or of the transparent sheet 7, by greater or lesser engagement of the ball 10 in the groove 11.

In large frames, the number of catches may be increased, for example up to eight. Likewise, for small frames, the number of catches may be limited to two.

Figure 6:
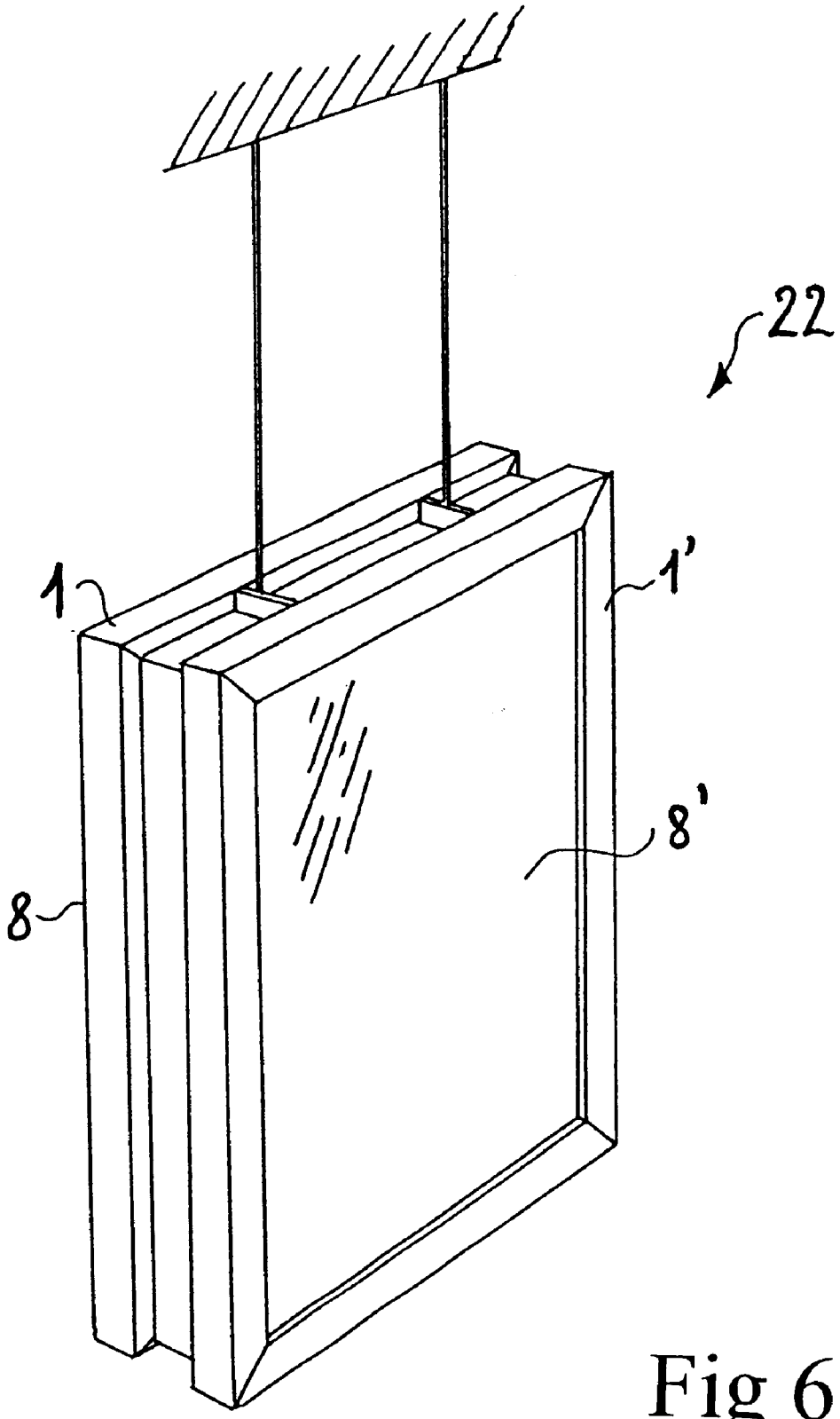
FIG. 6 is an isometric perspective view of one particular way of applying devices according to the invention.

The frame according to the invention may be applied against an opaque support, such as a wall. Another way of using the device is shown in FIG. 6. As shown in FIG. 6, the two back elements 3; 13; 17 of two devices 1 and 1' according to the invention may be fixed together, back to back. These two devices 1 and 1' preferably have the same dimensions. The whole assembly 22 may therefore be hung from the ceiling by cables, or held in place by any other suitable means. Two documents 8 and 8' may therefore be used, visible from each side. This way of using the device finds application in thoroughfares, such as the entrance hall of a bank.

The frame, which is rectangular in the examples illustrated, may, without departing from the scope of the invention, be made in any other shape, for example octagonal. It may also include a locking device.

The sections may be coated with any aesthetically pleasing finish, such as lacquer, or may be treated by anodizing them.

What is claimed is:

1. A device for the presentation of flat documents, enabling the document to be replaced by opening and closing the device, which includes:

a back element;

a document having a thickness; and a frame capable of surrounding the back element, the frame including a rim suitable for bearing against a periphery of the document, wherein the back element includes at least one flexing-element for fastening the frame to the back element, each comprising a part capable of deforming elastically, each part capable of deforming elastically applies, when the device is in a closed state, a clamping force against the frame, causing in reaction the documents to be clamped between the rim and the back element, said clamping force varying continuously with the thickness of the document.

2. A device for the presentation of flat documents, allowing presentation of documents on both faces, wherein said device is formed by two devices according to claim 1 being joined back to back.

3. A device according to claim 1, wherein a transparent sheet is interposed between the document and the rim.

4. A device for the presentation of flat documents, allowing presentation of documents on both faces, wherein said device is formed by two devices according to claim 3 being joined back to back.

5. A device according to claim 1 or 3, wherein in its upper part, the back element includes a means for holding the document in place.

6. A device according to claim 1 or claim 3, wherein the frame has a plurality of inner faces, and on at least two of its inner faces, includes a groove into which said fixing elements can engage.

7. A device according to claim 6, wherein the fixing elements are ball catches.

8. A device according to claim 7, wherein the frame consists of an assembly of aluminium sections.

9. A device according to claim 8, wherein the back element comprises an inner frame consisting of an assembly of sections and a back sheet.

10. A device according to claim 9, wherein the sections are made of aluminium.

11. A device according to claim 9, wherein the back sheet is transparent.

12. A device according to claim 9, wherein the back sheet is made of agglomerated wood.

13. A device according to claim 9, wherein the back sheet is made of polyvinylchloride.

14. A device according to claim 8, wherein the back element is a solid panel.

15. A device according to claim 14, wherein the solid panel is a panel of agglomerated-wood particles.

16. A device according to claim 15, wherein the panel of agglomerated-wood particles is a medium-density fiberboard panel.

17. A device according to claim 8, wherein the back element includes a back sheet and at least one added piece.

18. A device according to claim 17, wherein the said at least one added piece is made of a material chosen from the group consisting of wood, agglomerated wood and polyvinylchloride.

19. A device for the presentation of flat documents, enabling the document to be replaced by opening and closing the device, which includes:

a back element;

a document having a thickness;

a frame capable of surrounding the back element, the frame including a rim suitable for bearing against a periphery of the document, wherein the back element includes at least one fixing element for fastening the frame to the back element, each comprising a part capable of deforming elastically, each part capable of deforming elastically applies, when the device is in a closed state, a clamping force against the frame, causing in reaction the document to be clamped between the rim and the back element, said clamping force being continuously applied to accommodate variations in the thickness of the document.

* * * * *

UNITED STATES PATENT AND TRADEMARK OFFICE

CERTIFICATE OF CORRECTION

PATENT NO. : 6,354,031 B1
DATED : March 12, 2002
INVENTOR(S) : Oliver Meur

It is certified that error appears in the above-identified patent and that said Letters Patent is hereby corrected as shown below:

Column 9,
Line 31, insert -- 10 -- after ball (first occurrence).

Signed and Sealed this

Fifteenth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,354,031 B1
DATED : March 12, 2002
INVENTOR(S) : Oliver Meur

It is certified that error appears in the above-identified patent and that said Letters Patent is hereby corrected as shown below:

Column 4,
Line 31, insert -- 10 -- after ball (first occurrence).

Signed and Sealed this

Tenth Day of December, 2002

JAMES E. ROGAN
*Director of the United States Patent and Trademark Office*